US006637748B1

(12) United States Patent
Yuan

(10) Patent No.: US 6,637,748 B1
(45) Date of Patent: Oct. 28, 2003

(54) CASINO CARD GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 0 days.

(21) Appl. No.: 10/243,700

(22) Filed: Sep. 13, 2002

(51) Int. Cl.[7] ..... A63F 9/20
(52) U.S. Cl. ..... 273/292
(58) Field of Search ..... 273/292, 274, 273/309; 463/12, 13

(56) References Cited

U.S. PATENT DOCUMENTS 5,713,574 A * 2/1998 Hughes ..... 273/292
5,810,663 A * 9/1998 Bochichio et al. ..... 463/13
5,863,042 A * 1/1999 Lo ..... 273/292
6,511,072 B1 * 1/2003 Santa Cruz et al. ..... 273/292

OTHER PUBLICATIONS

"9's Up", Harrah's Gaming Guide: How To Play, Harrah's Lake Tahoe Resort Casino brochure, 1988.*

* cited by examiner

*Primary Examiner*—Benjamin H. Layno
(74) *Attorney, Agent, or Firm*—Anderson & Morishita, L.L.C.; Robert Ryan Morishita

(57) ABSTRACT

A card game method begins by dealing four cards each to an initial player hand and an initial dealer hand. A final player hand and final dealer hand are formed by selecting three cards from the initial player hand and the initial dealer hand, respectively. The final player hand is compared to the final dealer hand and the higher ranking final hand is declared the winning hand. Optionally, two or more range sets are defined. One card of the initial dealer hand is designated a range card and the range set containing the range card is designated a winning range set.

12 Claims, 5 Drawing Sheets

CASINO CARD GAME

FIELD OF THE INVENTION

The present invention relates to card games. Specifically, the present card game is a method of playing a card game between at least one player and a dealer using conventional playing cards in which a subset of a quantity of dealt cards are selected to form a final hand for a player and a dealer.

BACKGROUND OF THE INVENTION

Casino games include many subsets of games. In one subset, players wager on which of two or more hands will win. For example, Baccarat is a live table game that uses a standard deck of fifty-two playing cards. The object of Baccarat is for a player to successfully wager on which of two hands, designated the Bank hand and the Player hand, is going to win. The player is paid even money for the wager if he or she wagers on the winning hand and loses the wager if he or she selects the losing hand.

Play of Baccarat is commenced after all wagers are made by dealing two cards to the Bank position and two cards are dealt from the shoe to the Player position on the table layout. The cards are turned face up and the values of the Bank hand and the Player hand is determined by summing the face values of the cards in each hand. If the sum of the cards are added together, the total of the hand exceeds nine, then the hand value is determined modulo ten. In other words, all hand values range from a low of zero to a high of nine. For example, a seven and a eight total fifteen, but the hand value is five. An Ace and a nine total ten, but the hand value is zero. Whichever of the Bank hand or the Player hand is closest to a total of nine is the winner.

Depending on the point total of the initial Player hand and the initial Bank hand, one more card may be dealt to either the Player hand, the Bank hand or both. The rules for determining whether a third card is dealt are fixed; that is, there is no discretion for either the Player hand or the Bank hand on whether a third card is dealt.

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total: | Bank hand DRAWS when the Player's hand third card is: | Bank hand STANDS when the Player's hand third card is: |
|---|---|---|
| 0,1,or 2 | Bank always draws | |
| 3 | 0,1,2,3,4,5,6,7 or 9 | 8 |
| 4 | 2,3,4,5,6 or 7 | 0,1,8 or 9 |
| 5 | 4,5,6 or 7 | 0,1,2,3,8 or 9 |
| 6 | 6 or 7 | 0,1,2,3,4,5,8 or 9 |
| 7 | | Bank always stands |

At the end of each hand, winning wagers are paid and losing wagers are collected by the house. Any commission due to the house is marked in commission boxes in the center of the table.

One drawback of Baccarat is that the draw rules are fixed. That is, as discussed above, there is no discretion in when a player may draw and when a player may stand. Many players dislike the lack of interactivity in Baccarat.

Additionally, all the wagers of Bacarrat are mutually exclusive. That is, a player only has three mutually exclusive choices: Player, Bank, or Tie. Thus, when one player wagers on Bank and another player wagers on Player, the two players are playing against each other despite the fact that neither has a hand of his or her own.

Another subset of games includes games in which cards dealt to a player are combined into a single player's hand that is compared to a dealer hand. For example, in Blackjack, each player places a wager. A dealer deals two cards to each player and to himself. The dealer's cards are dealt with one card face up and the other face down. All players receiving a natural twenty-one or Blackjack, i.e. a total of twenty-one in the initial dealt hand, are immediately rewarded and their cards collected. Typically, Blackjacks are rewarded at greater than even money, such as 2:1 or 3:2.

Each remaining player may opt to hit, i.e. receive one or more additional cards, or stand, i.e. stand on the player's current hand, with the object being to obtain a hand total closer to twenty-one than the dealer's hand total. If the player hits and receives a card that causes his hand total to exceed twenty-one, the player busts and the player's wager is immediately collected and play is terminated as to that player.

A player may also have additional options available depending on the initial hand dealt. If the player receives a pair, i.e. two cards having the same face value, the player may double his wager and split the pair, using each card of the pair as a base for a separate hand. For example, if a player were to be dealt a pair of eights, the player may split the pair by doubling his wager and playing with two hands each having an eight and an additional dealt card.

A player may also have the option to double down. Although the availability of the double down option varies from casino to casino, doubling down allows a player to double the player's wager in exchange for a single additional card. Frequently, the double down option is only available to players having an initial hand total of ten or eleven.

After all the players have formed a final hand or busted, the dealer reveals the dealer's hand and forms a final dealer hand by hitting or standing as the house rules dictate. House rules typically require the dealer to hit on any hand total less than sixteen. The dealer resolves wagers by rewarding, typically at even money, all players with a final hand total closer to twenty-one than the dealer's final hand total. Conversely, wagers are collected from players with a final hand total further from twenty-one than the dealer's final hand total. If the dealer busts, i.e. has a final hand total exceeding twenty-one, all players who did not bust or receive a Blackjack are rewarded, again, typically at even money. If the player and dealer push, i.e. have the same final hand total, the player's wager is returned.

Blackjack has its drawbacks, however. Since each player plays his or her own hand, there is no "team" feeling to the game such as that found in other games like Baccarat.

SUMMARY OF THE INVENTION

A card game is played between at least one player and a dealer using conventional playing cards. In a first aspect of the present invention, the game begins with the dealer dealing four cards to an initial player hand and four cards to an initial dealer hand. The game may be played where each player wagers on, is dealt, and plays a separate player hand or, in an alternate optional embodiment, where only two hands are dealt—a player hand and a dealer hand—and players may select to wager on either hand.

In an optional embodiment, the initial player hand and initial dealer hand are examined. If the initial player hand comprises four of a kind and the initial dealer hand does not comprise a higher ranking four of a kind, the initial player hand is declared a winning hand and play ends with respect to that initial player hand. Similarly, in a further optional embodiment, if the initial dealer hand comprises four of a kind and the initial player hand does not comprise a higher ranking four of a kind, the initial dealer hand is declared a winning hand and play ends with respect to that initial player hand.

If the player hand, and in an optional embodiment the dealer hand, does not have a four of a kind, three cards are selected from the initial player hand to form a final player hand and three cards are selected from the initial dealer hand to form a final dealer hand. The final player hand is compared to the final dealer hand. Optionally, the hand rankings, in descending order are: three of a kind of face cards, pair of face cards with an unmatched face card, three unmatched face cards, and three of a kind of threes, with all other hands assigned the sum of the face values of the cards modulo ten. Optionally, ten-spot cards and face cards have a value of zero when summing the card face values. The final hand with the higher rank is the winning hand.

In a second aspect of the game, two or more range sets are defined. In an optional embodiment, a first range set includes the cards Ace through six inclusive, optionally referred to as a Lo wager, and a second range set includes the cards seven through Queen inclusive, optionally referred to as a Hi wager. Players place a base wager on a player hand or a dealer hand or place a range wager on a selected range set of cards or place both a base wager and a range wager. Play continues similar to a first aspect in that four cards are dealt to an initial player hand and four cards are dealt to an initial dealer hand. One card from among the four cards dealt to the initial dealer hand is designated a range card. The range card serves two separate purposes: first, the range card serves to resolve the range wagers, if any; second, the range card may be used along with any of the other three cards to form the three-card final dealer hand.

Thus, three cards are selected from among the four cards dealt to the initial player hand to form a final player hand and three cards are selected from among the four cards, including the range card, dealt to the initial dealer hand to form a final dealer hand. The final player hand and final dealer hand are compared and the final hand with the higher ranking is declared the winning hand. Optionally, the final hands are ranked in the following descending order: three of a kind of face cards, pair of face cards with an unmatched face card, three unmatched face cards, three of a kind of threes, with all other hands assigned the sum of the face values of the cards modulo ten wherein ten-spot cards and face cards have a value of zero. Any player wagering on the winning hand is rewarded on his or her base wager.

Additionally, it is determined which, if any, of the range sets the range card falls. Any player wagering on the winning range set, that is a range set including the range card, is rewarded on his or her range wager.

In a further optional embodiment of a second aspect of the present invention, prior to forming a final player hand and a final dealer hand, the initial player hand and initial dealer hand may be examined to determine whether either includes four of a kind. In such an optional embodiment, if the initial player hand comprises four of a kind and the initial dealer hand does not comprise a higher ranking four of a kind, the initial player hand being declared a winning hand and play ending with respect to that initial player hand. In a further optional embodiment, if the initial dealer hand comprises four of a kind and the initial player hand does not comprise a higher ranking four of a kind, the initial dealer hand is declared a winning hand and play ends.

DESCRIPTION

Figure 1:
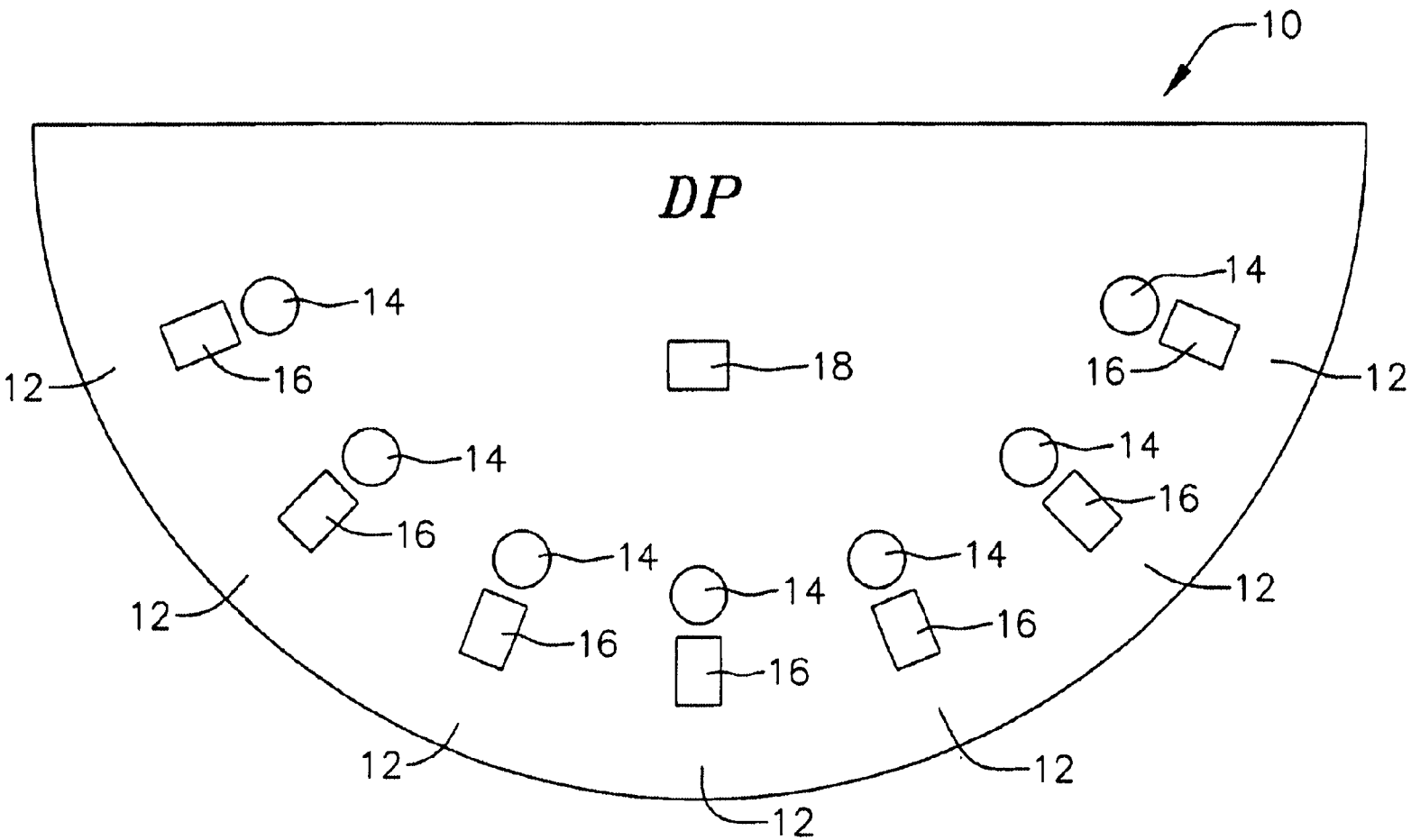
FIG. 1 is a top view of a layout used to conduct play of a card game method according to an optional embodiment of the present invention.
Figure 2:
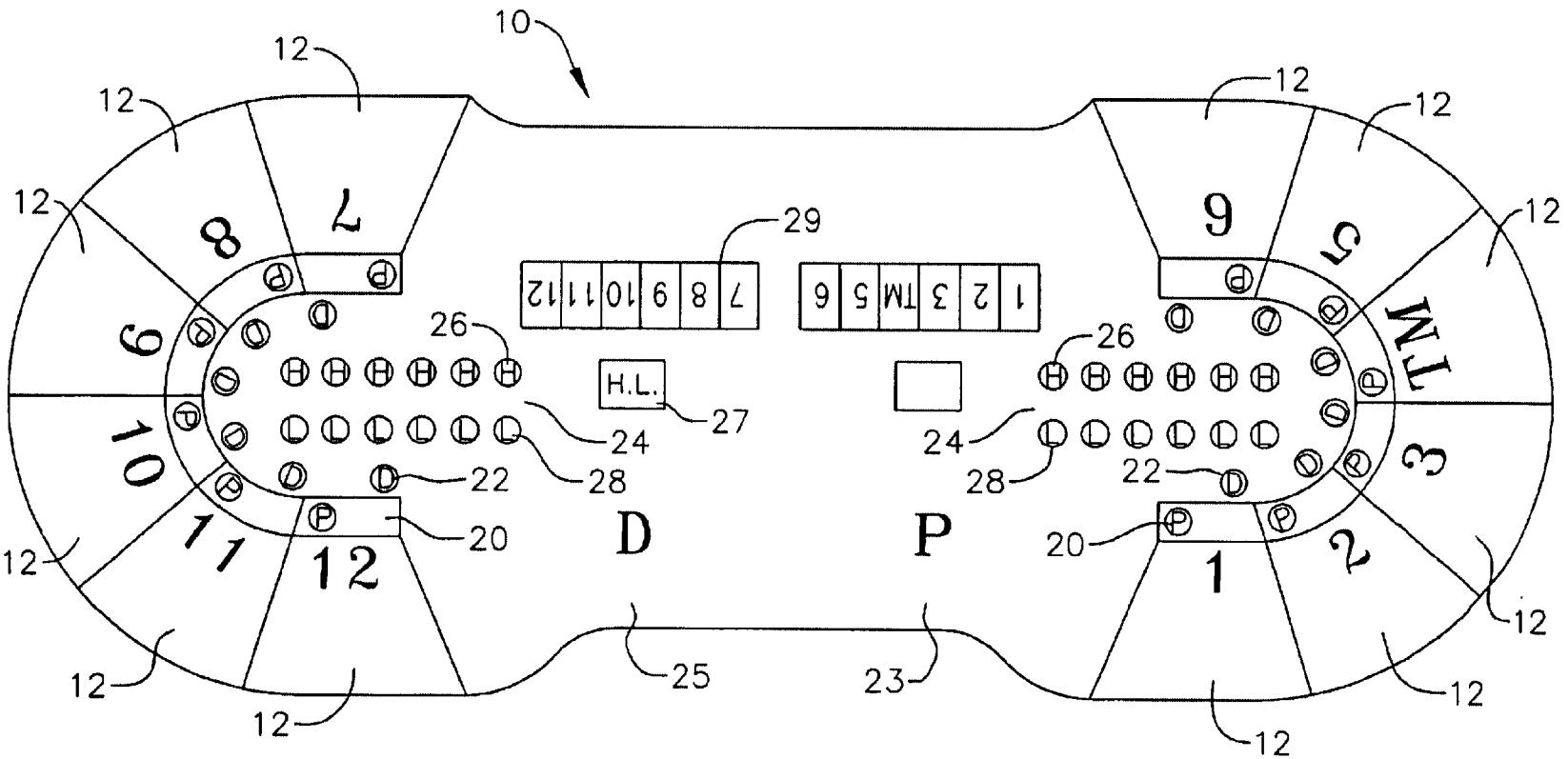
FIG. 2 is a top view of a layout used to conduct play of a card game method according to another optional embodiment of the present invention.
Figure 3:
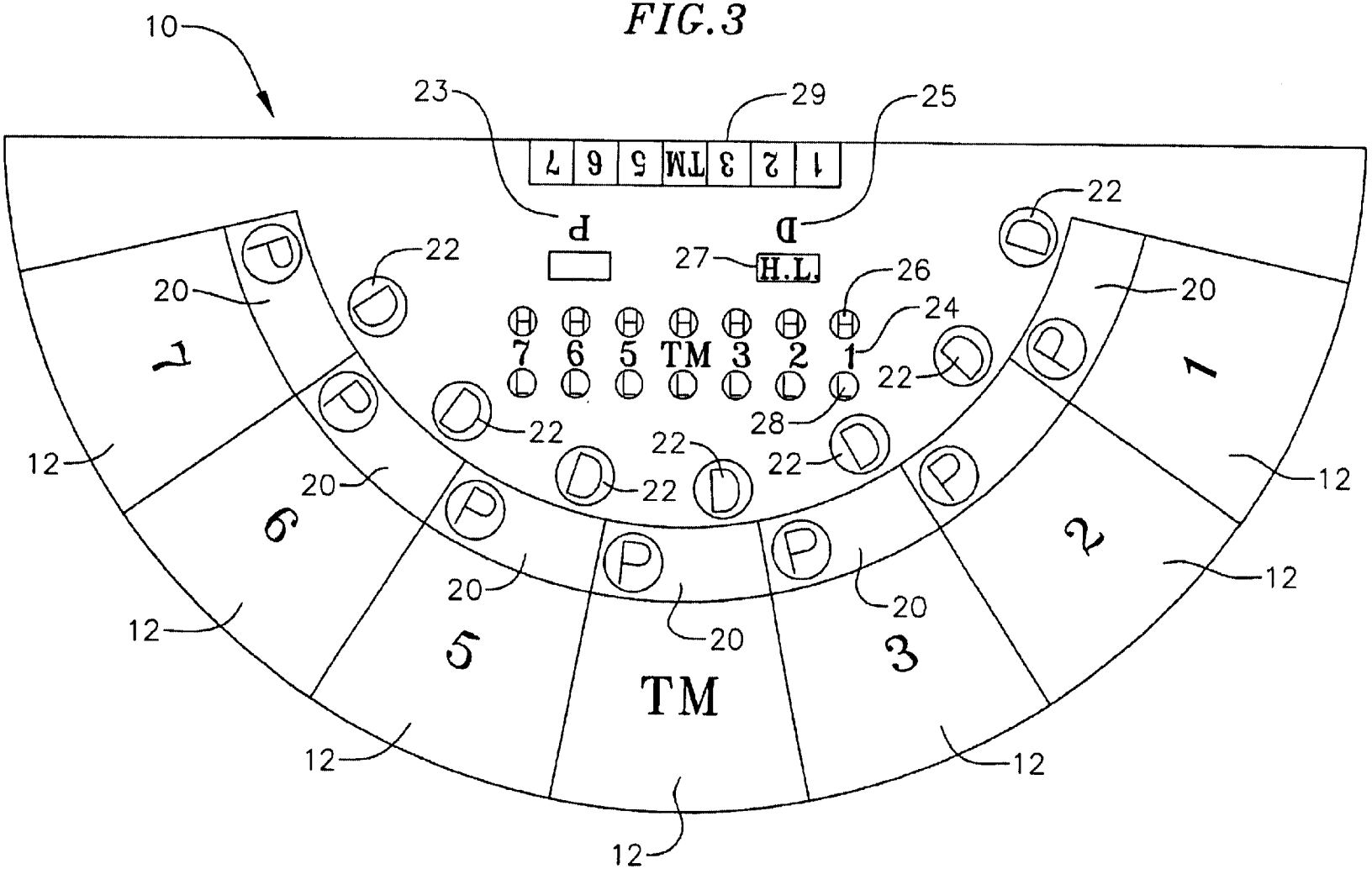
FIG. 3 is a top view of a layout used to conduct play of a card game method according to another optional embodiment of the present invention.

Reference is now made to the figures wherein like parts are referred to by like numerals throughout. The present invention is a card game played using conventional playing cards. While any number of cards or decks of cards may be used, it is contemplated that a single deck or multiple decks may be used. Referring first to FIGS. 1–3, the game of the present invention may be played on a layout 10. The layout 10 may vary depending on the specific embodiment of the game played. For example, a first aspect of the game, described in greater detail below, may be played on a layout 10 such as those shown in FIG. 1. Such a layout 10 includes a plurality of player positions 12 with a wagering area 14 and a player hand action area 16 for each player position 12. A dealer hand action area 18 is also provided.

Alternatively, a second aspect of the present invention, described in greater detail below, may be played on a layout 10 such as that shown in FIGS. 2 and 3. The optional layouts 10 for such an optional embodiment generally include a plurality of player positions 12 with a player hand wagering area 20, a dealer hand wagering area 22, and a range wagering area 24 for each player position 12. The dealer hand wagering area 22 optionally includes the designation "D" and the player hand wagering area 20 optionally includes the designation "P" to distinguish them from one another.

The range wagering area 24 is optionally divided into two sub-areas 26, 28. In the optional embodiment of FIGS. 2 and 3, the sub-areas include the designation "H" for a "Hi" range 26, described in greater detail below, and "L" for a "Lo" range 28, also described in greater detail below.

With continued reference to FIGS. 2 and 3, the layout 10 for an optional second aspect of the present game method includes a player hand action area 23 and a dealer hand action area 25. The dealer hand action area 25 optionally includes a range card area 27 to separate and distinguish the range card, the purpose of which is described in greater detail below. In an embodiment in which the house charges a commission on winning wagers, commission boxes 29 may be included on the layout 10 to track commissions owed.

Figure 4:
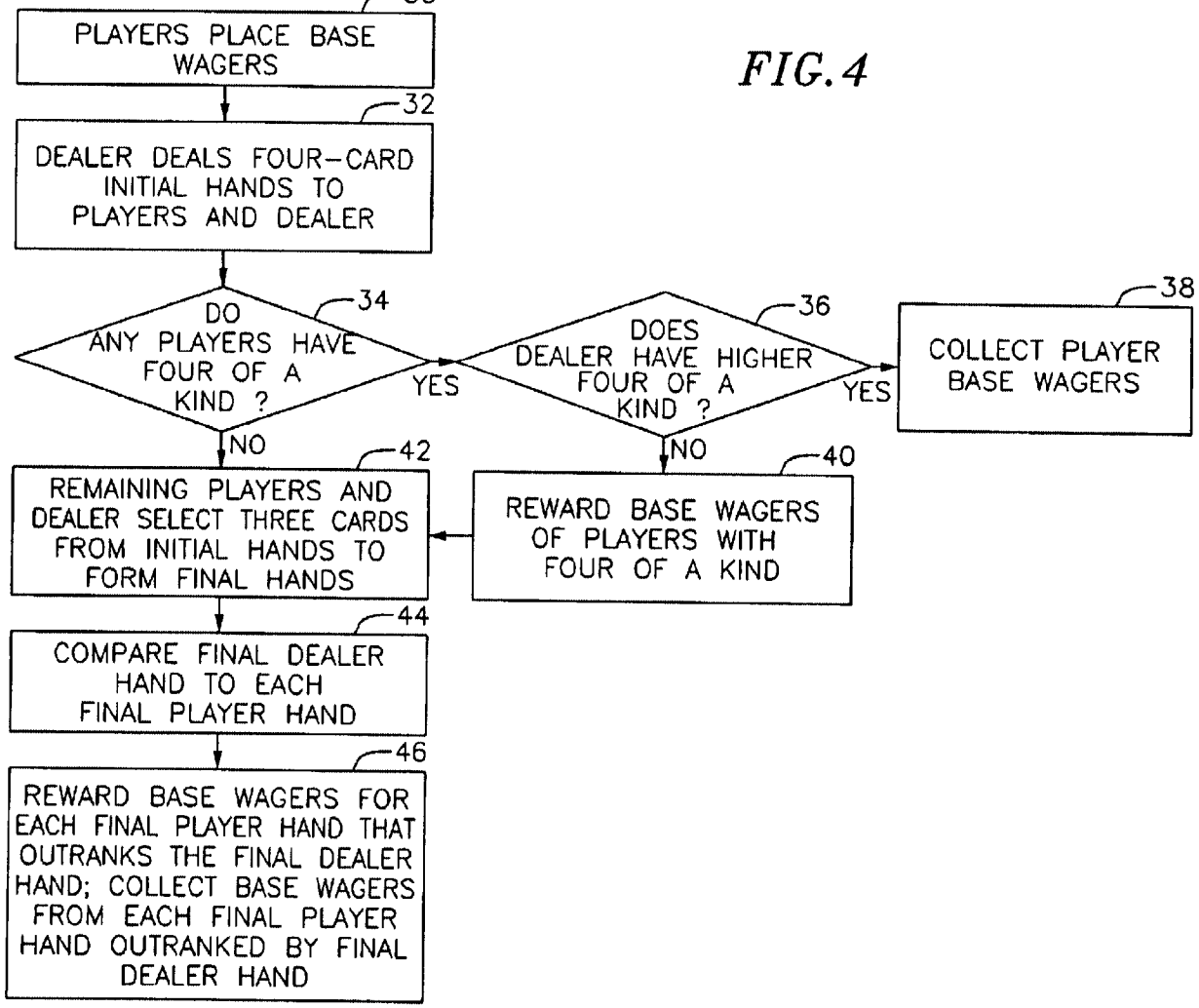
FIG. 4 is a flow chart of a card game method according to an optional embodiment of the present invention.

Turning to the game method itself, FIG. 4 illustrates an optional embodiment according to a first aspect of the present invention. The card game of the present invention is played between at least one player and a dealer using conventional playing cards. In a first aspect of the present game, each player plays an individual hand against a dealer hand. In an embodiment of the present invention intended for casino or card room play, each player places 30 a wager in a wagering area 14 corresponding to the player's position 12. Each player is dealt 32 an initial player hand of four cards to the player's hand action area 16. A four-card initial dealer hand is also dealt 32 to the dealer hand action area 18.

In an optional embodiment, an optional comparison of the initial player hand to the initial dealer hand is made. In such an optional embodiment, if the initial player hand includes 34 four of a kind, and the initial dealer hand does not include a higher ranking four of a kind, the initial player hand is declared 40 a winning hand and play ends as to that player hand. Similarly, in a further optional embodiment, if the initial dealer hand includes 36 four of a kind, and the initial player hand does not include a higher ranking four of a kind, the initial dealer hand is declared 38 a winning hand and play ends.

With continued reference to FIG. 4, if the game method does not include the optional initial hand comparison, or if the initial hand comparison reveals neither the player nor, in an optional embodiment, the dealer holds four of a kind, three cards are selected 42 from the initial player hand to form a final player hand and three cards are selected from the initial dealer hand to form a final dealer hand.

The final player hand is compared 44 to the final dealer hand. The final hand with the higher rank is the winning hand. If the final hands are tied, a push is declared.

Optionally, the hand rankings, in descending order, are: three of a kind of face cards, pair of face cards with an unmatched face card, three unmatched face cards, and three of a kind of threes, with all other hands assigned the sum of the face values of the cards modulo ten. That is, for hands not listed, the hand value equals the sum of the face value of the cards, unless the value is greater than ten, in which case the hand value is the ones digit of the sum. Thus computed, the hand value for such hands will range from zero to nine.

For example, 2♡ 2♣ 4♠ has a hand value of eight, 3♡ 5♣ 8♠ has a hand value of six, and A♡ 3♢ 5♠ has a hand value of nine. Optionally, ten-spot cards and face cards have a value of zero when summing the card face values. Thus, the hand 7♢ 10♣ J♠ has a hand value of seven and 10♡ J♢ J♣ has a hand value zero. It is noted that the pair of Jacks in the example is not counted as a pair because the third card is not a face card as required in the hand rankings above. The rankings are summarized in Table 1.

TABLE 1

| Hand | Examples |
|---|---|
| Three Matched Face Cards | K♡ K♢ K♣ |
| Two Matched Face Cards + One Unmatched Face Card | K♡ K♢ J♣ |
| Three Unmatched Face Cards | K♡ Q♢ J♣ |
| Three Threes | 3♢ 3♠ 3♣ |
| Sum of Values | all others |

Turning to the hand comparison, K♡ K♣ Q♣ would outrank K♡ K♣ J♣ (because a pair of Kings with a Queen outranks a pair of Kings with a Jack). By contrast, K♡ K♣ 6♣ would only have a sum of six and would not be counted as a pair because the third card is not a face card. Put another way, a pair of face cards is only considered a pair when the third card is an unmatched face card. Thus, J♡ J♣ 8♣ outranks K♡ K♣ 6♣ because the sum of eight is greater than the sum of six.

In the event that the sums of the cards is equal, the individual cards in each hand are compared with hand with the higher card winning. For example, 4♡ 5♢ 9♢ (for a hand value of eight) wins against a hand of 5♣ 6♣ 7♡ (for a hand value of eight) because the highest card of the first hand is greater than the highest card of the second hand. In an optional embodiment, a hand with a value of zero would not be compared in this way and would just be considered a zero hand. Thus, 3♢ 7♢ K♠ (for a hand value of zero) and 10♡ Q♣ Q♠ (for a hand value of zero) push, even though one has a King high and the other has a Queen high, because both have a zero sum.

Wagers are either collected or paid 46 based on whether the final player hand is a winning hand, losing hand, or a push when compared to the final dealer hand. The payouts and the handling of push outcomes could be altered as desired. For example, in an optional embodiment, pushes could be handled as a push outcome and the player's wager returned. However, in such an embodiment, the house may wish to retain a commission to adjust the house advantage. In an alternate optional embodiment, a commission is not charged but push outcomes may be considered player losing outcomes with the player's wager collected. It is further contemplated that these options may be adjusted, used, or not used as desired and as dictated by the desired house advantage.

Figure 5:
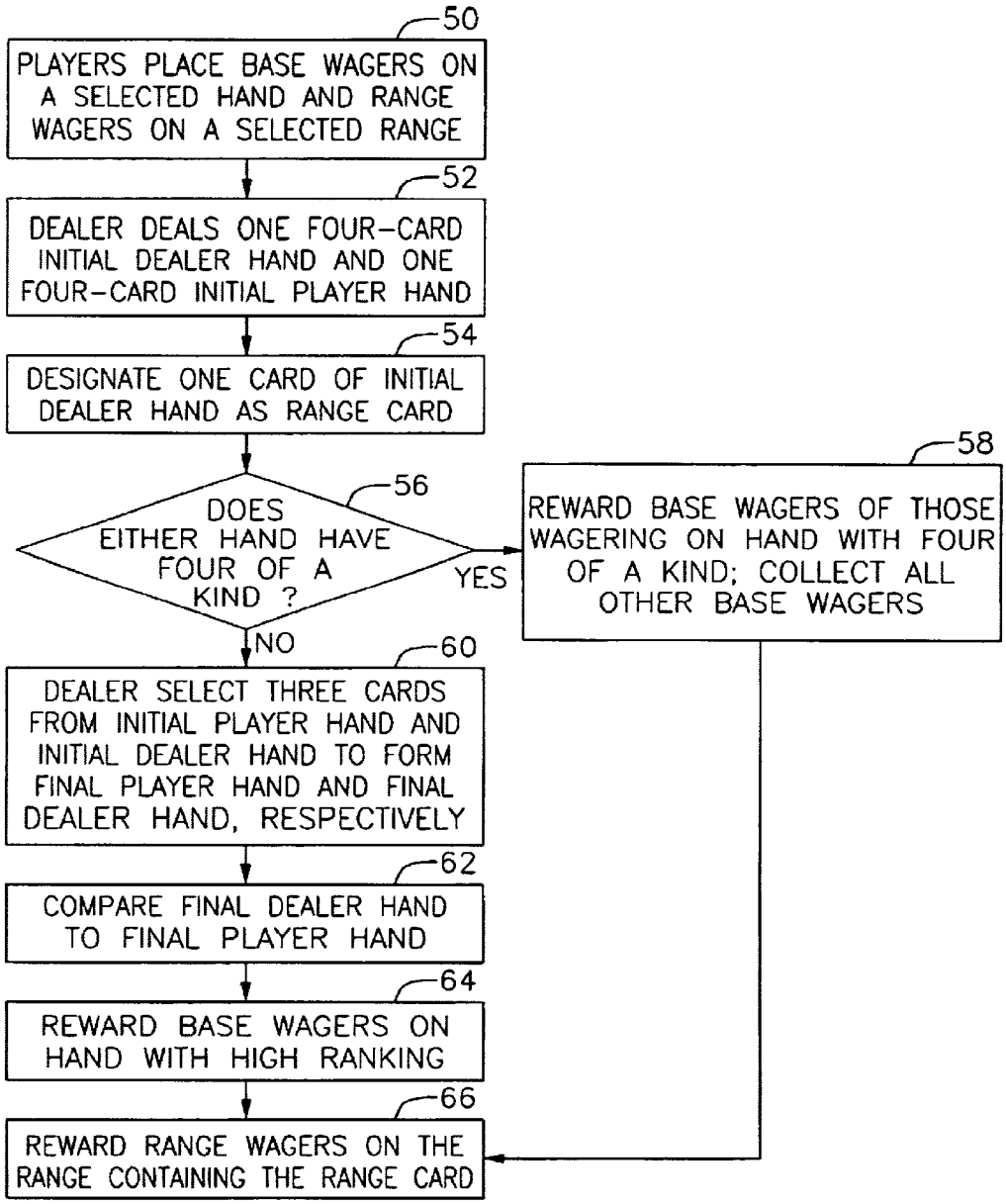
FIG. 5 is a flow chart of a card game method according to another optional embodiment of the present invention.

In a second aspect of the present game, shown in FIG. 5, only two hands are dealt and played—a player hand and a dealer hand. In such an embodiment, players select to place a base wager 50 on either the player hand or the dealer hand by placing his or her wager on either the player hand wagering area 20 or dealer hand wagering area 22 at the player position 12.

An optional range wager may also be offered. In an embodiment in which a range wager is offered, two or more range sets are defined. For example, in one optional embodiment, a first range set includes the cards Ace through six inclusive, optionally referred to as a Lo wager, and a second range set includes the cards seven through Queen inclusive, optionally referred to as a Hi wager. Players opting to place an optional range wager are wagering that the value of a range card falls within a selected range set. Thus, in the optional embodiment of the example, a player selecting to place a Lo wager would place his or her wager in the "L" sub-area 28 and would be rewarded based on his or her range wager if a range card falls between Ace through six inclusive. Likewise, a player selecting to place a Hi wager would place his or her wager in the "H" sub-area 26 and would be rewarded based on his or her range wager if a range card falls between seven through Queen inclusive. In such an optional embodiment, a push is declared if the range card is a King.

Play in this second aspect is similar to a first aspect in that four cards are dealt 52 to an initial player hand and four cards are dealt 52 to an initial dealer hand. In an embodiment including a range wager, one card from among the four cards dealt to the initial dealer hand is designated 54 a range card. As illustrated in FIGS. 2 and 3, the range card may be designated by placing the range card in a range card area 27 at the dealer hand action area 25. The range card in such an optional embodiment, is randomly selected, such as, for example, designating the fourth card dealt to the initial dealer hand to be the range card. For example, in dealing the initial dealer hand, the dealer may deal his first three cards to the dealer hand action area 25 and deal the fourth card to the range card area 27 without revealing, viewing, or otherwise exposing the card, thereby randomly designating one card from the initial dealer hand to be the range card.

As with a first aspect of the present game, in an optional embodiment, the initial player hand and initial dealer hand are examined to determine 56 whether either includes four of a kind. In such an optional embodiment, if the initial player hand includes four of a kind, and the initial dealer hand does not include a higher ranking four of a kind, the initial player hand is declared 58 a winning hand and play ends as to that player hand. Similarly, in a further optional embodiment, if the initial dealer hand includes four of a kind, and the initial player hand does not include a higher ranking four of a kind, the initial dealer hand is declared 58 a winning hand and play ends.

Referring again to FIG. 4, once both the initial dealer hand and initial player hand are dealt, three cards from among the four cards dealt to the initial player hand are selected 60 to form a final player hand. It is contemplated that either the player or the dealer may set the final player hand, however, if the dealer sets the final player hand, the cards are revealed face-up to show that the final player hand has been properly formed. Optionally, the highest bettor may be permitted to peek at some or all of the cards of the initial player hand.

Similarly, three cards from among the four cards dealt to the initial dealer hand are selected 60 to form a final dealer hand. In an optional embodiment in which one of the cards from the initial dealer hand is designated a range card, the dealer may form the final dealer hand from any of the four cards including the range card. That is, the range card serves two separate purposes: first, the range card serves to resolve the range wagers, if any; second, the range card may be used along with any of the other three cards to form the three-card final dealer hand. Thus, the three cards that form the final dealer hand are selected from among the four cards, including the range card, dealt to the initial dealer hand.

The final player hand and final dealer hand are compared 62. The final hand with the higher ranking is declared the winning hand. While any ranking system could be used, the final hands are optionally ranked in the following descending order: three of a kind of face cards; pair of face cards with an unmatched face card; three unmatched face cards; three of a kind of threes; with all other hands assigned the sum of the face values of the cards modulo ten, wherein ten-spot cards and face cards have a value of zero. As above, if the sum of the cards is equal, the individual cards of each hand are compared with the hand having the highest card winning. In an optional embodiment, this rule is not applied to zero sum hands. Any player wagering on the winning hand is rewarded 64 on his or her base wager. It is contemplated that the house may retain a commission on winning wagers or that the house may push or win tie hands as necessitated by the desired or required house advantage.

Additionally, it is determined which, if any, of the range sets the range card falls as described in the example above. Any player wagering on the winning range set, that is a range set including the range card, is rewarded 66 on his or her range wager.

While certain embodiments of the present invention have been shown and described it is to be understood that the present invention is subject to many modifications and changes without departing from the spirit and scope of the claims presented herein.

I claim:

1. A method of playing a card game between at least one player and a dealer using conventional playing cards, comprising:

the dealer dealing four cards to an initial player hand;

the dealer dealing four cards to an initial dealer hand;

examining the initial player hand and initial dealer hand;

if the initial player hand comprises four of a kind and the initial dealer hand does not comprise a higher ranking four of kind, the initial player hand being declared a winning hand and play ending with respect to that initial player hand;

otherwise, selecting three cards from the initial player hand to form a final player hand and selecting three cards from the initial dealer hand to form a final dealer hand;

comparing the final player hand to the final dealer hand according to the following ranking in descending order: three of a kind of face cards, pair of face cards with an unmatched face card, three unmatched face cards, three of a kind of threes, and all other hands assigned the sum of the face values of the cards modulo ten, wherein ten-spot cards and face cards have a value of zero; and declaring the higher ranking hand to be a wining hand.

2. The method of claim 1 further comprising:

if the initial dealer hand comprises four of a kind and the initial player hand does not comprise a higher ranking four of a kind, the initial dealer hand is declared a winning hand and play ends.

3. The method of claim 1 further comprising:

defining two or more range sets, each range set including one or more cards;

designating one card from among the four cards dealt to the initial dealer hand to be a range card; and designating a range set containing said range card to be a winning range set.

4. The method of claim 3 wherein one of said range sets comprises the cards Ace through six, inclusive, and another of said range sets comprises the cards seven through Queen, inclusive.

5. A method of playing a card game between at least one player and a dealer using conventional playing cards, comprising:

the player placing a base wager on a player hand or a dealer hand;

defining two or more range sets, each range set including one or more cards;

the player opting to place a range wager on a range set;

the dealer dealing four cards to an initial player hand;

the dealer dealing four cards to an initial dealer hand, with one card designated a range card;

selecting three cards from among the four cards dealt to the initial player hand to form a final player hand and selecting three cards from among the four cards, including the range card, dealt to the initial dealer hand to form a final dealer hand;

comparing the final player hand to the final dealer hand and declaring the higher ranking hand to be a winning hand;

rewarding base wagers placed in a winning hand and collecting all other base wagers; and rewarding range wagers placed on a range set containing said range card.

6. The method of claim 5 further comprising:

examining the initial player hand and initial dealer hand; and if the initial player hand comprises four of a kind and the initial dealer hand does not comprise a higher ranking four of a kind, the initial player hand being declared a winning hand and play ending with respect to that initial player hand.

7. The method of claim 5 further comprising:

examining the initial player hand and initial dealer hand; and if the initial dealer hand comprises four of a kind and the initial player hand does not comprise a higher ranking four of a kind, the initial dealer hand is declared a winning hand and play ends.

8. The method of claim 5 wherein one of said range sets comprises the cards Ace through six, inclusive, and another of said range sets comprises the cards seven through Queen, inclusive.

9. The method of claim 5 wherein the step of comparing the final player hand to the final dealer hand is performed according to the following ranking in descending order: three of a kind of face cards, pair of face cards with an unmatched face card, three unmatched face cards, three of a kind of threes, and all other hands assigned the sum of the face values of the cards modulo ten, wherein ten-spot cards and face cards have a value of zero.

10. A method of playing a card game between at least one player and a dealer using conventional playing cards, comprising:

the player placing a base wager on a player hand or a dealer hand;

defining two or more range sets, each range set including one or more cards;

the player opting to place a range wager on a range set;

the dealer dealing four cards to an initial player hand;

the dealer dealing four cards to an initial dealer hand, with one card designated a range card;

examining the initial player hand and initial dealer hand;

if the initial player hand comprises four of a kind and the initial dealer hand does not comprise a higher ranking four of a kind, the initial player hand being declared a winning hand and play ending with respect to that initial player hand;

otherwise, selecting three cards from among the four cards dealt to the initial player hand to form a final player hand and selecting three cards from among the four cards, including the range card, dealt to the initial dealer hand to form a final dealer hand;

comparing the final player hand to the final dealer hand according to the following ranking in descending order: three of a kind of face cards, pair of face cards with an unmatched face card, three unmatched face cards, three of a kind of threes, and all other hands assigned the sum of the face values of the cards modulo ten, wherein ten-spot cards and face cards have a value of zero;

declaring the higher ranking hand to be a winning hand;

rewarding base wagers placed in a winning hand and collecting all other base wagers; and rewarding range wagers placed on a range set containing said range card and collecting all other range wagers.

11. The method of claim 10 further comprising:

if the initial dealer hand comprises four of a kind and the initial player hand does not comprise a higher ranking four of a kind, the initial dealer hand is declared a winning hand and play ends.

12. The method of claim 10 wherein one of said range sets comprises the cards Ace through six, inclusive, and another of said range sets comprises the cards seven through Queen, inclusive.

* * * * *